United States Patent [19]

Rumpf et al.

[11] 4,153,541

[45] May 8, 1979

[54] METHOD AND APPARATUS FOR THE CONTINUOUS CENTRIFUGAL CLASSIFYING OF A CONTINUOUS FLOW OF PARTICULATE MATERIAL IN A DEFLECTED FLOW

[76] Inventors: Hans Rumpf, Hansjakobstr. 12; Karl Maly, Bachstrasse 46, both of 7500 Karlsruhe; Kurt Leschonski, Am Dammgraben 20, 3392 Clausthal-Zellerfeld, all of Fed. Rep. of Germany

[21] Appl. No.: 718,158

[22] Filed: Aug. 27, 1976

[30] Foreign Application Priority Data

Aug. 27, 1975 [DE] Fed. Rep. of Germany ..... 2538190

[51] Int. Cl.[2] ..... B07B 7/086

[52] U.S. Cl. ..... 209/143; 209/210; 209/146

[58] Field of Search ..... 209/143, 133, 134, 145, 209/210, 135–137, 146, 147, 154, 502, 497

[56] References Cited

U.S. PATENT DOCUMENTS

| | | | |
|---|---|---|---|
| 3,311,234 | 3/1967 | Rumpf et al. | 209/147 |
| 3,315,806 | 4/1967 | Sigwart et al. | 209/143 |
| 3,520,407 | 7/1970 | Rumpf et al. | 209/148 |

FOREIGN PATENT DOCUMENTS

| | | | |
|---|---|---|---|
| 940196 | 3/1956 | Fed. Rep. of Germany | 209/143 |
| 636327 | 3/1962 | Italy | 209/210 |
| 245654 | 8/1947 | Switzerland | 209/137 |

*Primary Examiner*—Frank W. Lutter
*Assistant Examiner*—Jon E. Hokanson
*Attorney, Agent, or Firm*—Kenyon & Kenyon, Reilly, Carr & Chapin

[57] ABSTRACT

A continuous flow of material is separated in a continuous centrifugal classifying method into at least one fraction of coarse material and at least one fraction of fine material using a deflected flow with the stream of material introduced in a thin layer into a classifying flow which is deflected in a classifying region, the classifying flow being internally adjacent a curved inner deflection wall having an inner deflection angle greater than approximately 45° and, the classifying flow also extending externally along a smaller outer deflection angle which is not defined by a wall but along which an outer flow for discharging the fraction of coarse material is established flowing substantially parallel to the inner deflection wall with the ratio between the radii of the outer and inner curvature being less than approximately 5 to 1, with the material to be classified introduced in the neighborhood of the beginning of the curvature of the inner deflection wall with a speed component in the direction of classifying flow which is at least half the speed of the classifying flow and which is in a direction which does not deviate by more than 45° from the direction of the classifying flow with the fine material being primarily discharged with the outflowing classifying flow after being fanned out and the coarse material discharged with the external flow.

37 Claims, 12 Drawing Figures

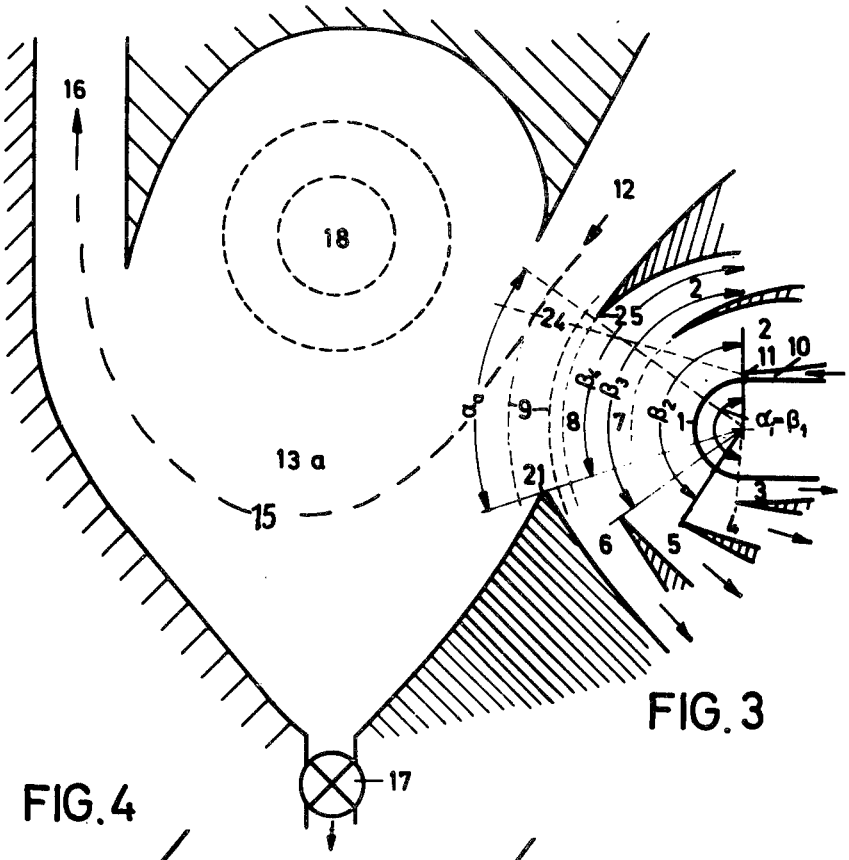
FIG. 3
FIG. 4
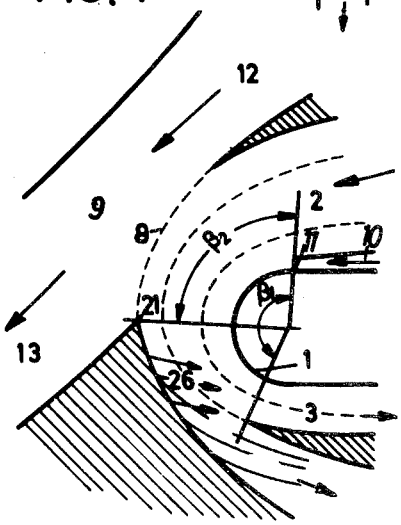
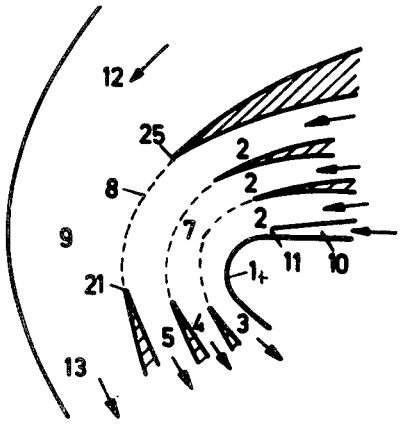
FIG. 5

METHOD AND APPARATUS FOR THE CONTINUOUS CENTRIFUGAL CLASSIFYING OF A CONTINUOUS FLOW OF PARTICULATE MATERIAL IN A DEFLECTED FLOW

BACKGROUND OF THE INVENTION

This invention relates to a method, and a device for continuous centrifugal classifying of a continuous flow of particulate material and more particularly such a method permitting classification into at least one fraction of coarse material and at leat one fraction of fine material in a deflected flow, either in a gaseous fluid at cut-off sizes between approximately 1 μm and 100 μm, if the mass flow ratio of the supplied material to the flow of classifying gas is up to approximately 10, or in a liquid fluid at cut-off sizes between approximately 10 μm and 1 mm, the Reynolds number related to the radial transverse extension of the classifying flow being greater than 2,000. The Reynolds number is defined as:

$$Re = v \cdot d / \nu$$

in which v is the speed of the fluid, $\nu$ is the kinematic viscosity of the fluid, and d is the radial transverse extension of the deflected flow.

In some known classifying methods and devices, separation occurs in a flow deflected by walls. The most well known and widely used application, which also applies to the separation of material uniformly divided in a flow of fluid, is deflection classification in a deflection or "slat" classifier. Slat classifiers are used, for example, in oval fluid energy mills. Another embodiment of a slat classifier is described in U.S. Pat. No. 3,006,470. In slat classifiers, the fluid, uniformly charged with the material for sifting, flows in a channel which is usually straight. After leaving the channel, some of the fluid is sharply deflected by a lateral slat system comprising a relatively large number of parallel slats forming parallel outflow channels between them, and is thus discharged. The deflected fluid entrains the fine material, whereas the coarse material remains in the fluid, which flows in straight lines. The front edges of the slats are relatively sharp. Consequently, the flow is deflected around relatively sharp edges having a radius of curvature which is very small compared with the dimensions of the straight channel and the entire length of the slats in the flow direction. The material for sifting is relatively uniformly distributed in the inflow channel. Owing to these characteristics of deflection classifying in a slat classifier, the selectivity is relatively low for classifying below 100 μm and relatively high loads of material. The relatively sharp deflection also necessitates a high pressure drop, i.e., a high energy requirement. The deflected flow in a slat classifier is a curved non-parallel flow which separates at the sharp deflection edges. In the flow, similar particles of material move along different trajectories, depending on the centrifugal force exerted on them in accordance with the initial position.

It is also known for classification to occur in flows which are not curved by deflecting walls or guided along walls. Such classification is performed, for example, in "spiral air classifiers" having a housing which is annular in cross-section and in which an axially symmetrical flow is maintained in an inward spiral. Such a method, therefore, is not comparable with deflection classification. In the case of spiral air classification, the fine material in the curved spiral flow moves inwards whereas the coarse material flows outwards, relative to the curved flow, towards the outer wall of the classifier housing, and is then removed. Spiral flow is suitable for fine classifying and is widely used for that purpose, but has a serious disadvantage in that particles of material which are at or near the cut-off size accumulate in the classifying chamber as a result of the equilibrium between the outward centrifugal force and the inward extraining force and, as a result of the concentration gradient, are diffused and discharge partly with the coarse material and partly with the fine material, thus reducing the selectivity. Since the classifier flow charged with fine material emerges axially from the classifier chamber, there are limitations to the axial width of the chamber and the throughput.

A disadvantage common to slat classifiers and spiral air classifiers is that the material can be separated into only two fractions.

Deflection classifying must also be distinguished from cross-current classifying as disclosed in British Pat. No. 1,088,599 and the corresponding U.S. Pat. No. 3,311,234, and British Pat. No. 1,194,213 and the corresponding U.S. Pat. No. 3,520,407 and the Canadian Pat. No. 834,558 in which the material is introduced at a given initial speed into a flow extending at an angle or almost in the opposite direction. In such a separator the coarse material travels through the flow. On the other hand, the particles of fine material are decelerated and deflected in the flow, the deceleration distance and the acceleration distance in the flow direction both depending on the particle size. These classifiers are unsuitable for very fine separation. This is clear from the fact that the deceleration distance of a particle of material having a diameter of 10 μm and a density of 1 g/cm$^3$ is only 5 mm in stagnant air at an initial speed of 30 m/sec. Counter-current and cross-current classifiers of this kind are not centrifugal classifiers in which the particles of material suspended at the center of the flow are subjected to centrifugal force owing to the curvature of the flow. Instead, they are deflected in the flow to an extent depending on their size, but only because their entry speed differs from that of the flow.

SUMMARY OF THE INVENTION

An object of the present invention is to provide a method and device for continuous centrifugal classifying in a deflected flow, so as to obtain very selective classifying within a wide cut-off size range, more particularly at very fine cut-off sizes below approximately 10 μm in gaseous fluids and below approximately 100 μm in liquid fluids and at comparatively high throughputs, and also at low throughputs. Another object is to achieve classifying in which the fine material contains substantially no particles of coarse material above a given size, and the coarse material contains substantially no (relatively coarse) fine material below a certain particle size.

In the art, the requirements regarding the selectivity of classifying vary considerably. For example, when classifying is combined with grinding, the coarse material must be substantially free from fine material. On the other hand, the absence of coarse particles in the fine material is less important, for example, when cement is ground and simultaneously classified. On the other hand, in applications requiring very fine classifying, for example, the classifying of fillers and toner, it is of increasing importance that the fine material be substantially free from particles of coarse material and that it have very low particle sizes, e.g. 10 μm or less, in which case the cut-off sizes must be considerably lower. In the case of known classifiers, these requirements are impossible to meet or are possible only in conjunction with small throughputs, i.e. amounts of the order of 100 kg/h or less.

No classifying is absolutely selective. If the particle size which is divided in the proportions 50:50 between coarse material and fine material is called $d_{50}$ (cut-off size) and the particle size out of which 10%, 25%, 75%, 90% etc. goes into the coarse material is denoted by $d_{10}$, $d_{25}$, $d_{75}$, $d_{90}$ etc., very selective classification is denoted by the selectivity coefficient $K=D_{25}/d_{75}=0.7$. Many industrial classifying processes, in contrast to the process for analyzing the particle size distribution, have a selectivity coefficient K of less than 0.5. As explained, however, the coefficient K is not adequate to characterize the classifying quality. If the fine material has to be free from relatively coarse material, the critical particle sizes are $d_{99}$, $d_{99.9}$, $d_{100}$. In practice they can be measured only in a given sample quantity, e.g., by wet mechanical analysis or micro-analysis of a 10 gm. sample. The following Table gives characteristic average values of the ratio between the particle size $d_{90}$:$d_{50}$ for highly selective classifying (K=0.7) and for moderately selective classifying (K=0.5):

| | $D_{75}/d_{50}$ | $d_{90}/d_{50}$ | $d_{99}/d_{50}$ |
|---|---|---|---|
| K = 0.7 | 1.2 | 1.4 | 1.8 |
| K = 0.5 | 1.4 | 2 | 3.3 |

The requirement that a given $d_{100}$ must be reached, is considerably harder than, for example reaching $d_{99.9}$ or $D_{99.99}$, since it is found by experience that, in each flow classifying process, it is often extremely difficult to ensure that no "oversize" particles above a certain size enter the fine material. Consequently, even in selective very fine classifying, $d_{100}/d_{50}$ is often above 4.

In many industrial classifying processes, particularly at high loads, the values $d_{25}$, $d_{10}$, $d_5$ are never reached at all, since, for example, more than 25% of all particle sizes below $d_{50}$ reach the coarse material.

The object of the present invention, in the case of a device for continuous centrifugal classifying of a continuous flow of material into at least one fraction of coarse material and at least one fraction of fine material in a deflected flow, is attained in that the stream of material is introduced in a thin layer in a classifying flow which is deflected, in the classifying region, which is internally adjacent a curved inner deflection wall, along an inner deflection angle greater than approximately 45° and and which extends externally along a smaller outer deflection angle, along which it is not guided by any wall, adjacent an outer flow for carrying away the fraction of coarse material and substantially parallel to the inner deflection wall, the ratio between the radii of outer and inner curvature being less than approximately 5:1, the internal speed component in the neighborhood of the beginning of the curvature of the inner deflection wall in the direction of the classifying flow being at least half the speed of the classifying flow at this introduction point, at a direction deviating by not more than 45° from the direction of the classifying flow, and the fine material or each fraction of fine material, after being fanned out by centrifugal force, is discharged with the outflowing classifying flow and not more than a part of the external flow, and the coarse material or each fraction of coarse material is discharged with the external flow and not more than a part of the classifying flow.

A device according to the present invention, suitable for performing this method for centrifugal classifying in a deflected classifying flow, has a flow channel for conveying a classifying flow, a material supply device opening on to one side of the channel at a material introduction point, a coarse material outflow aperture for coarse material to flow out of the classifying flow provided in the channel wall on the side opposite the material introduction point, one edge of the outlet aperture forming its end and obliquely opposing the trajectory of the material, and a coarse material discharge device adjacent the coarse material outlet aperture outside the flow channel. The device is so constructed that the flow channel, in order to deflect the classifying flow, is continuously curved inward at a deflection angle greater than approximately 45°. In the region of the beginning of the inner channel curvature in the neighborhood of the inner deflection wall, the mouth of a material supply device is provided for supplying the stream of material in a thin layer and in a direction deviating by less than 45° from the classifying flow. The edge forming the end of the coarse material discharge aperture is disposed as a continuation of the outer channel wall ending at the beginning of the coarse material outlet aperture, after an outer deflection angle less than the inner deflection angle, and is eventually somewhat displaced radially thereto. The ratio between the radii of the outer and inner curvature of the flow channel is less than 5:1, and, at the side of the coarse material outlet aperture near the flow channel, a supply channel for material free fluid opens in the coarse material discharge direction at the beginning of the coarse material discharge aperture and the fluid emerges from the supply channel substantially parallel to the classifying flow, in order to discharge the fraction of coarse material.

The inner deflection angle is at least 60° for medium-fine cut-off sizes and at least 90° for very fine cut-off sizes. Usually it is between 90° and 180°. Preferably, in the case of a gaseous fluid, the speed component of the stream of material entering the classifying flow is approximately equal to the speed of the classifying flow at the point of introduction. The ratio between the radii of the outer and inner curvature of the flow (technically called the "deflected wall jet") deflected by the deflecting wall in the classifying region is preferably approximately 3:1 to 2:1. The radius of curvature of the inner deflecting wall of the flow channel should be at least 1 cm. Advantageously, it may decrease in the flow direction. The speed of the classifying flow, in the case of a gaseous fluid, can be adjusted between 10 m/sec. and 300 m/sec., depending on the cut-off size. The stream of material can be supplied to the classifying flow either mechanically or, preferably, in a carrier flow in which the particles are suspended. The classifying takes place in the flow directed around the inner deflecting wall. the deflection wall or the coarse material outlet aperture, the flow or the flow channel can be readily subdivided into a number or inflow and outflow channels.

According to an important feature of the invention, use is made of the "Coanda" effect for the classifying flow. This effect occurs at a curved deflection wall and results in a curved wall jet. Consequently, the sifting or classifying flow is a deflected, curved flow which internally abuts a deflecting wall but is not externally guided by a wall and thus has a free jet boundary which is adjacent an outer flow. The centrifugal forces occurring in the deflected wall jet are used for separating the particles of material, whereas the free outer flow boundary makes the coarse material only leave the classifying flow.

The systematic use of a deflected wall jet, more particularly for classifying, particularly in the case of relatively high loads (a large amount of material per average amount of fluid) and high requirements on the selectivity and fineness of the cut-off size, necessitates a number of geometrical and flow features and features relating to the motion of the material, which clearly distinguish the invention from the prior art. Selective very fine classifying at cut-off sizes between 1 and 20 micron are extremely difficult because the fine particles of material follow turbulent fluctuations in a flow and each disturbance to the flow. Frequently the disturbances are caused or accentuated by the material itself. Consequently, the flow conditions for material free flows or for coarse classifying cannot be applied to very fine classifying.

The method according to the present invention can be used for fine classifying down to cut-off sizes of the order of 1 micron, if there are extremely high requirements on the absence of coarse particles in the fine materials and if the throughput is relatively high, or for selective separation with coarse material free from fine material, if there is a further great increase in throughput and somewhat lower requirements relating to the absence of coarse material in the fine material. In many applications it has a very valuable advantage in that a number of fractions can be sharply separated in a single passage.

The invention can be applied to gaseous and liquid fluids. It relates to classifying in a deflected flow at Reynolds numbers of 2000 to about 1,000,000, related to the radial transverse extension of the classifying flow, i.e. outside the laminar region. The main application is to dry classifying, i.e. classifying in gaseous fluids, more particularly air, and wet classifying, e.g. in the treatment of ore. The invention may also be applied to continuous classifying of small quantities for on-line measurement and adjustment of grinding installations.

According to the present invention, in which for the first time a classifying flow is deliberately deflected for classifying purposes at a not too sharply bent deflection wall using the Coanda effect, the flow is adjacent the wall, owing to the resulting negative pressure, and is therefore deflected. A jet can be deflected in known manner, e.g. by inserting a finger into the side of a water jet. However, it is not easy to deflect it through a given angle, since the negative pressure at the wall boundary layer returns to normal and the flow comes away from the wall. If the flow is charged with particles of material, the material moves outwards owing to the centrifugal force in the flow and exerts an additional radial, outwardly directed force on the flow, thus further increasing the tendency to separate. In the case of fine cut-off sizes, it is also necessary to produce deflection around a maximum deflection angle when flow occurs parallel to the curved deflection wall. To this end, according to the present invention, the outer deflection angle ($\alpha_a$, see FIGS. 1 and 3) along which the classifying flow does not touch the wall but is adjacent the outer flow used for removing the coarse material, is less than the inner deflection angle ($\alpha_i$, see FIGS. 1 and 3) at the curved inner deflection wall. Usually the outer deflection angle is within the limits of the inner deflection angle. As far as possible, the classifying flow is guided in front of and behind its free outer flow boundary, through which the coarse material leaves it. Except when the jet deflection is small, the inner and outer deflection angles cannot be equal without seriously affecting the separation. Even when the deflection is small, however, the outer deflection angle should be made smaller.

The outer flow, which occurs outside the free outer flow boundary of the classifying flow, is an important feature of the invention. It is used for removing the coarse material. The result, according to the present invention, is that no coarse material flows back through the jet boundary into the classifying flow. This condition, which is extremely important for selective classifying and in which not even a small proportion of coarse material returns to the fine material, becomes increasingly difficult in proportion to the length of the free outer flow boundary. This is another reason for selecting a small outer deflection angle.

According to the present invention, selective classifying is achieved by substantial parallelism of the classifying flow. It is essential to avoid disturbances to parallelism in which the streamlines locally approach or overlap. Disturbances can be avoided if the direction of the inflow into the classifying region and the direction of the outflow of fluid from the classifying region are not parallel to the inner deflection wall; another method is to produce flow separation during inflow and a reflux and flow separation from the boundary walls and edges of the flow channel or channels during the outflow. A feedback effect on the classifying flow is produced by damming or flow separation in the outflow channel, or in the outflow channels if a number of discharge channels for the classifying flow or the outer flow are provided for discharging the coarse material in order to divide the fine material or coarse material each into a number of fractions. The feedback effect is intensified by the material in the flow. A material free flow is much easier to make parallel, although it should be noted that, as a result of the Coanda effect, the deflected jet has a tendency to become constricted, which is disadvantageous in the case of very fine separation. Owing to the interaction between the flow and the material in it, simple experiments are the most rapid way of finding the optimum adjustment in dependence on the material load. The flow can be observed if the lateral walls of the flow channel are made transparent.

In order to deflect the flow, a certain pressure drop is required. It depends on the ratio between the radii ($r_a$:$r_i$, FIG. 1) of the outer and the inner curvature of the classifying flow. This also has an important effect on the parallelism of the classifying flow. Accordingly to the invention, therefore, the ratio between the radii should be less than approximately 5:1, preferably approximately 3:1 to 2:1.

The curved deflected classifying flow may also be influenced and stabilized by the outer flow used for discharging the coarse material. Usually the outer flow is slower than the classifying flow, thus resulting in a flow or jet boundary with turbulent mixing. In order to avoid this mixing, the two flow speeds are brought close together or made equal. The latter method is specially advantageous when the speed of the classifying flow is relatively low, i.e. for relatively coarse separation, or when the coarse material in the outer flow also has to be classified into a number of fractions.

According to the present invention, the stream of material or particles is supplied at the material introduction point in a limited layer, which is thin compared with the radial dimension of the classifying flow, at a speed which is at least half and preferably the same and in the same direction as the classifying flow, the deviation being not greater than 45°. In this manner, the material is fanned out in a particularly efficient manner by centrifugal force in the classifying flow, the coarse particles moving further outwards than the fine particles. In order to make use of the fanning out, the supply point must be near the inner deflection wall at or in front of the beginning of the curve.

If the material introduction point is directly at the curved inner deflection wall, very fine particles may stick there. It has been observed that in many cases the amount of stuck particles does not increase, so that there is no disturbance. In many other cases, however, it may be advantageous to introduce the stream of material at a radial distance from the curved inner deflection wall, the distance being less than the radial distance from the outer classifying current boundary. In such cases, the classifying flow directly adjacent the deflecting wall remains substantially free from material, so that material cannot stick. This also reduces the danger of flow separation in the material free region. On the other hand, there is an increase in the amount of fluid required and the pressure drop, if the radial extension of the entire classifying region is relatively large.

Out of the material fanned out in the classifying region, the fine material is usually discharged only by the outflowing classifying flow and the coarse material only by the external flow, from which it can be subsequently separated by conventional means. It may, however, be advantageous to discharge a small part of the outer flow together with the classifying flow, or a small part of the classifying flow together with the outer flow. If a number of fractions of fine and/or coarse material have to be obtained, a number of outflow channels are provided in the radial direction on the coarse material or fine material side, as is known in the case of transverse flow classifying (see British Patent Specification No. 1,088,599 and the corresponding U.S. Pat. No. 3,311,234).

The flow must be exactly parallel to the deflection wall; this is particularly important at very low cut-off sizes, e.g., between 1 and 10 μm in the case of a gaseous fluid.

When the separation is coarser, the flow parallelism is not so critical. It may even be advantageous to accelerate all or part of the classifying flow in the classifying region, by reducing the inlet apertures of the outflow channels. In this flow system, an inwardly directed flow component occurs in the acceleration region at the place where the curved flow runs parallel to the inner deflection wall. This reduces the fanning out in the region of finer particle sizes, whereas the fanning out is increased in the region of coarser particle sizes. This is advantageous for coarser separation. The reason is that, if the curved classifying flow is adjusted to very fine separation, particles above a certain size move upwards with only slight deflection, and are only slightly fanned out. If the speed is adjusted, the maximum fanning out can occur in the desired cut-off size region. According to the invention, the speed in the classifying region can be varied within very wide limits.

Advantageously, in the case of fine separation with maximum parallelism of the stream in the classifying region, the speed there is kept constant. This is the easiest method of avoiding flow disturbances, caused e.g. by differences in the inflow speed of the flow layers. On the other hand, in order to reduce the amount of fluid required, it may be advantageous for the fluid to move at maximum speed in the inner flow layer and at lower speeds further out. However, the decrease in speed outwards is limited by the flow stability conditions.

Advantageously, in the case of very fine classifying where there are high requirements on selectivity and absence of oversized particles in the fine material, the material is supplied in the flow direction at the same speed as the fluid. In that case, fanning out is produced by centrifugal force alone. As a first approximation, the radial travel of the particles is proportional to the speed at which they sink, their peripheral speed and the deflection angle. The cut-off size between the fractions is determined by the position of the leading or front edge of the walls bounding the outflow channels. If, for example, limestone has to be classified in air at a cut-off size of 1 μm, and if the deflection angle is 180° and the speed of the classifying flow is 200 m/sec., it is calculated that the radial travel of the particles (about 1 μm in size) and consequently the radial distance between the front edge of the inmost boundary wall and the deflection wall or between the front edge and the the material introduction point, is almost 6 mm. If the cut-off size is 2 μm, the aforementioned radial minimum distance is 19 mm. These calculated values are substantially valid for practical classifying, if the parallelism of the flow of fluid is properly adjusted.

If there are no extreme requirements on the selectivity of very fine classifying, there is somewhat greater freedom in the choice of the direction and speed of the flow of material at the introduction point. In that case, neither the direction nor the value of the inflow speed need be exactly equal to that of the flow speed. It may be advantageous, when the stream of particles is introduced, for the speed to be given a certain radial component, though this should not be greater than the speed component in the direction of the classifying flow. As a result of this component, the coarse particles move further outward than the fine particles. This may be advantageous in the case of fanning out in an average range of particle sizes.

Preferably, the material is introduced into the classifying flow in a carrier flow, i.e., by pneumatic means, when a gaseous fluid is used for classifying. In this case, the classifying flow may be disturbed if the material and its carrier flows in at a different direction from the classifying flow; in this case, therefore, care should be taken that the classifying flow and the flow of incoming material are in the same direction.

The trajectories of the coarsest particles supply a limit up to which the classifying flow (or each partial flow if the classifying flow is subdivided) can be guided in the flow direction before coarse particles strike the channel walls. The latter must be avoided at any cost. On the other hand, to ensure maximum guidance according to the invention, the outer boundary wall, or the boundary wall of the outer channel, should end not far in front of the trajectory of the coarsest particles. The boundary walls of the inflow channels should be streamlined, to prevent turbulence from being produced therein as a result of separation of the outflow, and being transferred to the classifying flow.

For the reasons given, the boundary walls of the outflow channels should also be streamlined and smooth. Preferably, they are slightly rounded at the front edge, thus preventing flow separation in the outflow ducts. Slight rounding is also advantageous so as to reduce wear. The position of these front edges in the direction of deflection or curvature is shown in FIG. 3 by a deflection angle $\beta_1$ to $\beta_4$, measured from a fixed point, e.g., the beginning of the curvature of the inner deflection wall. The innermost angle $\beta_1$ coincides with the inner deflection angle $\alpha_i$ of the classifying flow. In FIG. 3 it is approximately 180°. At smaller deflections, as used for coarser separation, the front edges of the boundary walls of the outflow channels can have the same angle of deflection. The edge of the flow channel separating the coarse material from fine material and forming the end of the coarse material outlet aperture need not lie on the same radius as the front edge of the outer boundary wall of the inflow channel or of the outer inflow channel of the classifying flow. It can be somewhat further inward of somewhat further outward. If the outer flow for separating the coarse material is used in at least two fractions, a part of the flow may also flow away through the outer outflow channel for the classifying flow.

It has been found that a disturbance free flow with a maximum deflection angle of 180° for the finest fraction, i.e., selective very fine classifying, can be achieved only if the outflow channel of the flow channel is radially subdivided transverse to the classifying flow by parallel guide vanes or the like, or if a number (at least two) of outflow channels are provided for the classifying flow and the front edges of the guide vanes and/or outer boundary walls are disposed at deflection angles which decrease outwardly ($\beta_1 > \beta_2 > \beta_3 > \beta_4$). This ensures that the flow has the desired strict parallelism with maximum inward deflection of the flow. If the radial dimension of the classifying flow is less, fewer boundary walls are needed, e.g., only two outflow channels.

On the other hand, there should not be excessive distances between the outer front edges of the outflow channels in the deflection direction, since slight secondary flows are produced at the inner boundary wall of a curved flow and are intensified by friction between the material and the wall. These secondary flows (indicated by arrows 26 in FIG. 4) are propagated obliquely inwards in the flow direction and entrain relatively coarse material inwards. They may penetrate across the front edge of the adjacent inward boundary wall into the next inward outflow channel, if the distance of the last-mentioned front edge in the deflection direction depends on the radial distance and on the material loading and the particle sizes.

For the same reason, difficulties arise regarding the selectivity and absence of oversized material in the fine material if the outer flow for removing the coarse material is externally guided in a channel whose boundary wall is substantially parallel to the classifiying flow. This is possible only when the material being treated is very fine and does not contain any relatively coarse, rebounding particles and if there is a sufficiently large distance between the outer wall of the coarse material discharge device and the outer classifying flow boundary and a sufficiently small distance between: (a) the front edge of the outermost outflow channel forming the classifying flow boundary or bounding the coarse material outlet aperture in the flow direction; and (b) the edge of the outermost inflow channel of the classifying flow, i.e., if the free flow boundary or the jet boundary are short. In such cases, flow disturbances do not penetrate inwards into the classifying region from the outer wall of the coarse material discharge device.

The curvature of the inner deflection wall adjacent the classifying flow can be circular, i.e. the radius of curvature can be constant. This however is not a necessary condition for the success of the method according to the invention. On the contrary, it has been found that under certain special conditions the optimum flow shapes may differ from circular curvature; more particularly the curvature may increase in the flow direction, i.e., the radius of curvature may decrease (see FIG. 6).

The turbulence of the classifying flow may be a disturbing factor, particularly in the case of very fine classifying in gaseous fluids. Accordingly, the turbulent mixing paths of the particles at an angle to the trajectories thereof must be small compared with the length of the trajectories. This limits the flow length. Either the deflection angle can be increased (in the case of small radii of curvature) or the deflection angle can be reduced, if the radii of curvature are larger. Selective separation in gaseous fluids can be obtained if the average radius of curvature of the inner wall is between 0.5 and 20 cm., more particularly between 1 and 10 cm. The radius of curvature can be made even larger when the deflection angles are small.

The cut-off size between coarse material and fine material is determined by the position of the front edge of the outer boundary wall of the outermost outflow channel for the classifying flow, the aforementioned front edge forming the coarse-material outlet aperture. The coarse material penetrates into the outer flow, which must be so guided that no particles above the coarse cut-off size return into the classifying flow. As a result, the outer flow is free from material or from relatively coarse particles when it is supplied parallel to the inner deflection wall near the outer classifying flow limit. In such cases, coarse particles are not returned to the classifying flow as a result of turbulent mixing between the outer flow and the classifying flow at the classifying flow boundary.

The return of coarse particles may als be due to uncontrolled particle motion, e.g., resulting from collisions with the walls.

The present invention provides a very effective method of preventing the return of coarse particles, in that the outer flow is conveyed in a substantially material free manner approximately parallel to the classifying flow and is discharged outwards together with the coarse material approximately in the mean direction of flight thereof, i.e., in the direction of the coarse material trajectories (FIGS. 1 and 10–12).

Another advantageous method of preventing coarse material from being returned to the classifying flow is as follows: the outer flow, which is supplied free from material, flows along the classifying flow boundary and then reaches a wide coarse material collecting chamber (FIGS. 2, 8). It is there conveyed substantially through a half-circle and discharged together with the coarse material through an outlet aperture in the outer wall. Some of the coarse material can also be removed from the coarse material chamber by gravity, e.g., through the bottom funnel of the coarse material collecting chamber, using a bucket wheel lock. The outer flow conveyed in a semicircle produces an inner vortex flow in the coarse material chamber (FIGS. 2, 8). Advantageously, the flow is guided, by discharging and supplying the outer flow and by subsequent deflection at the wall (FIGS. 2, 8), so that the particles of material therein are driven only in the direction towards the outer wall. This is achieved by a complete, likewise approximately semicircular, deflection back to the direction of the incoming flow. Advantageously, the distance between the outer wall of the coarse material discharge device or coarse material collecting chamber and the classifying flow limit is at least as great as the path travelled by the coarsest rebounding particles.

In the case of very fine classifying, the cut-off size for cut material is often below 50 μm, e.g. 15–25 μm. It is then possible, according to the invention, to separate the coarse material additionally at coarser cut-off sizes, by using the outer flow to classify the coarse material into two or more fractions. In that case, the outer flow can be supplied through one or more inflow channels. The flow must be discharged in two or more partial flows. The outermost partial flow moves the coarser fraction. Advantageously, the previously mentioned precautions are taken to avoid the return of the coarse material. The classification by the external flow is a combined transverse flow and deflection classification or, in known manner, pure transverse flow classifying. In transverse flow classifying, the material to be classified is as a rule introduced constantly at an angle into a flow. In the present case there is the additional advantage that the coarse material entering the outer flow has already been fanned out in a manner very advantageous for transverse flow classifying. Advantageously, the outer flow is adjusted so that it produces the maximum intensification in the fanning out of the coarse material over the desired range of cut sizes.

It is known to increase the selectivity of classifying more, particularly in a gaseous fluid, by connecting two classifiers in series and recycling the medium fraction, i.e., together with the product for treatment. An advantage of the classifying method according to the invention is that classifying into more than two fractions can occur simultaneously. There is thus no need of further classifying in order to recycle a middle fraction and thus increase the selectivity between the two neighboring fractions. In any case, this is necessary only when the selectivity has to be extremely high, so that the method according to the invention ensures extremely selective separation.

Classifying according to the invention can be carried out in a "flat" system, in a flat classifying flow using, a flat classifying device comprising a flow channel having a rectangular cross-section, or in an axially symmetrical device, an axially symmetrical classifying flow or an axially symmetrical classifying device comprising a flow channel having an annular cross-section. Examples of a flat classifying device are shown in FIGS. 1 to 8 and examples of an axially symmetrical classifying device are shown in FIGS. 9 to 12.

In the "flat" system the classifying flow occurs in planes parallel to the plane of the drawing between a front and rear wall bounding the flow channel. The width of the classifying region at right angles to the plane of flow or of the drawing can be given any required value.

In order to describe the efficiency, it is advantageous to give the mass flow of material and fluid in the form of specific mass flows related to the width of the classifying region. In many applications, the specific mass flow of supplied material can be kept at a value of the order of 100 kg/h·cm width of classifying region. If there are extremely high requirements regarding the fineness and the absence of oversized particles in the fine material, the specific mass flow for air classifying is made lower, e.g. between 20 and 50 kg/h·cm. Very high requirements can be satisfied with regard to the cut-off size and selectivity and absence of oversized particles from the fine material. This is a method of ensuring that, at a cut-off size of 2 μm, no coarse material occurs on a screen having a mesh width of 6 μm when 10 g of fine material is classified. ($d_{50}=2$ μm; $d_{100}=6$ μm). When the width of the classifying region is 50 cm, the amounts of material treated are from 1 to 2.5 t/h. If 0.1% of residue above 10 μm is permitted, a specific throughput of 150 kg/h·cm is obtained in very fine air classification of limestone ($d_{50}=2$ μm; $D_{99,9}=10$ μm). This corresponds to a throughput of 7.5 t/h when the width of the classifying region is 50 cm.

These outputs are several orders of magnitude higher than the throughputs of known air classifiers for similarly high fineness requirements. In addition, the known very fine classifiers have rotating parts and are much more expensive to produce. The invention can also ensure specific throughputs up to several hundred kg/h·cm with selective classifying and cut sizes about 10 μm. In the axially symmetrical device (FIGS. 9 to 12) the width of the classifying chamber in the flat classifier corresponds to the circumference of the circle with the average diameter (shown in the drawing) of the inner deflection wall (D in FIG. 8). Thus, at a diameter of 1 m, we obtain an equivalent classifying chamber width of approximately 3 m, and a throughput of 60 t/h at 200 kg/h·cm.

In the "axially symmetrical" system, the flow is axially symmetrical with respect to the central axis and is equal in all radial planes extending therethrough. The axially symmetrical system, compared with the flat system, has an additional possibility in that a rotating flow component around the central axis or axis of symmetry of the classifier can be imparted to the supplied material and the classifying flow, thus further improving the method according to the invention of deflecting the classifying flow around an inner deflecting wall.

Separation in the classifying region is not influenced by gravity. Consequently, the classifying region can be oriented in any manner required in space, i.e. material can be supplied horizontally (FIGS. 1 to 7), obliquely (FIG. 9), vertically downwards (FIGS. 10, 11) or vertically upwards (FIG. 12).

If the flow and the supply of material to the classifying region is vertical and if it is deflected outwards relative to the central axis of the classifier, the deflection of the classifying flow around the inner deflection wall can be increased by its rotational component around the central axis, thus intensifying the Coanda effect.

Advantageously, therefore, in classifying according to the present invention, a rotating flow component around the central axis of the system is imparted to the inner flow layer, which is preferably supplied free from material between the material inlet and the inner deflection wall. A possible embodiment is shown in FIG. 11.

To ensure sharp separation it is also necessary that all particles of material having the same size should enter at approximately the same speed and in approximately the same direction. In addition, all the particles of material, irrespective of their size, can be given the same speed on entry, with various accuracy obtained, depending on the manner in which the material is supplied. This is possible when material is supplied on a conveyor belt, more particularly on a belt covered by another belt moving at the same speed, the two belts entraining the feed between them. In the axially symmetrical system, the conveyor belt is replaced by a centrifugal plate, more particularly a plate in which the wall of the plate which is in contact with the feed is in the form of a concave conical or concave curved surface of rotation, at least in the outer region, and in which the wall is covered a short distance by a cover extending to the feed point.

It is very advantageous, in both the flat and the axially symmetrical system, for the material to be supplied in a fluid carrier, e.g., by pneumatic means.

Very advantageously also, in the case of the axially symmetrical system, the material is supplied either from above or below. The classifying flow can be deflected either outwardly or inwardly relative to the central axis. In this case, depending on the distribution of particle sizes in the material, it may be impossible to prevent the smaller particles having a higher average speed than the coarser particles. Accordingly, the components of the inflow speed of the coarsest particles in the direction of the speed of the fluid at the point of entry should be approximately equal to the flow speed, whereas the smaller particles, entering at the same direction, have an entry speed which increases continuously or stepwise with increasing particle size. Consequently the coarser particles are subjected to approximately the entire centrifugal force from the beginning and perhaps also to an additional radial component of motion, as a result of a radial component.

The advantage of pneumatic or hydraulic material supply is that the flow of material can easily be kept constant by maintaining a constant pressure drop along all or part of the conveying track by regulating the flow of material.

BRIEF DESCRIPTION OF THE DRAWINGS

FIG. 3 is a similar view of the classifying region of a flat classifying device having a number of inflow and outflow channels showing their position and extent;

FIG. 4 is a similar view illustrating the place of origin of possible secondary flows in an outflow channel;

FIG. 5 is a similar view illustrating a flat classifying device in which the flow channel is subdivided in the neighborhood of the inflow to and the outflow from the classifying region;

DETAILED DESCRIPTION OF THE INVENTION

Figure 1:
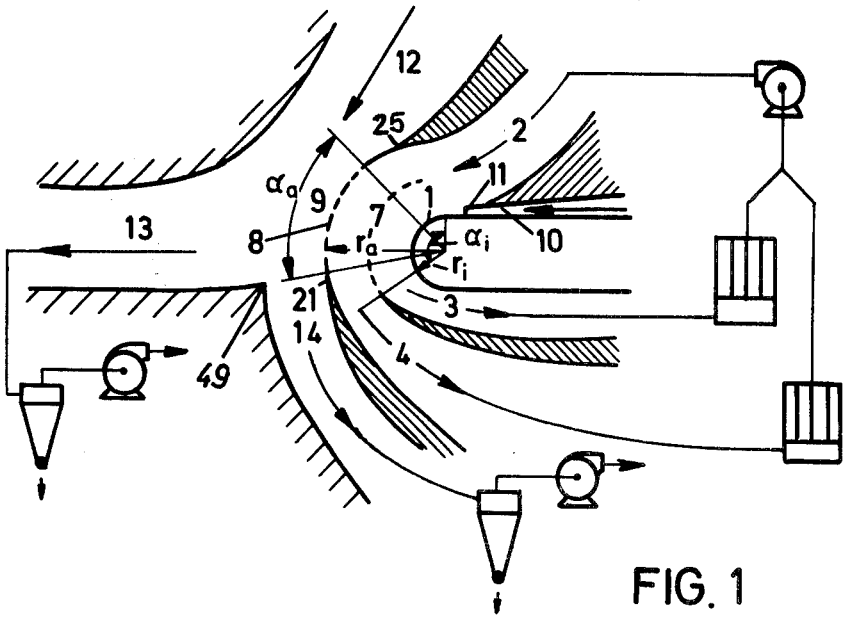
FIG. 1 is a cross sectional view of the classifying region of a flat classifying device having two coarse material outflow channels.
Figure 2:
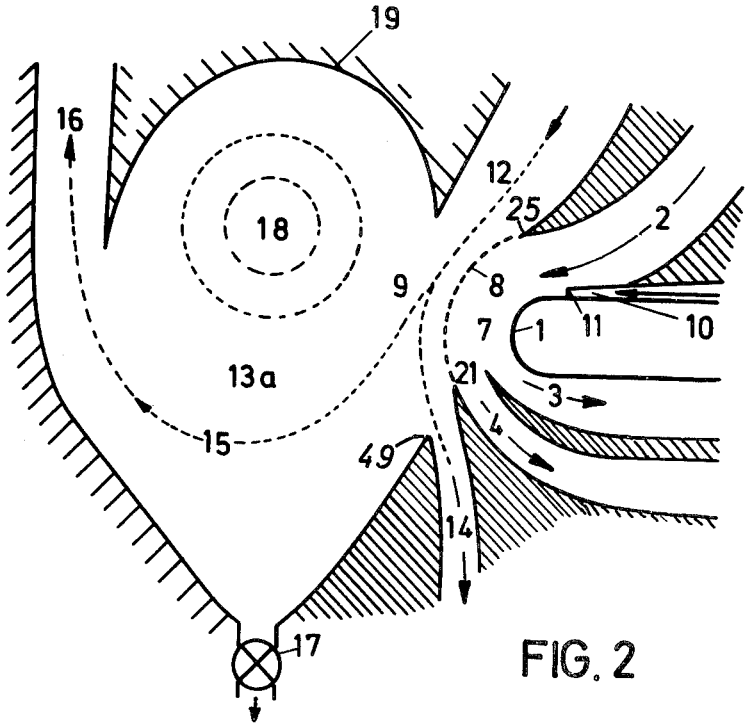
FIG. 2 is a similar view of a flat classifying device in which the coarse material discharge device comprises a collecting vessel for coarse material.

In all the embodiments of the classifying device of the present invention, classifying occurs in the classifying region 7 of a flow channel which is continuously bent to a varying extent in the neighborhood of the classifying region. The fluid, e.g., air, flows to region 7, for example, from a fan or blower, through a part of the flow channel shown as the inflow channel 2 (see FIG. 1) and flows out therefrom through a part of the flow channel shown as the outflow channel 3 (see FIG. 12). The inflow channel can also be subdivided into a number of inflow channels by boundary walls. For example, FIGS. 3, 9 and 11 each show two inflow channels 2 and FIGS. 5 and 8 show three inflow channels 2 or 2*a*, 2*b* and 2*c*. Instead of a single outflow channel 3 (see FIG. 12) there can be two outflow channels 3 and 4 (see FIGS. 1, 2, 4, 6, 7, 9, 10 and 11), three outflow channels 3, 4 and 5 (see FIG. 5) or four outflow channels 3, 4, 5 and 6 (see FIGS. 3 and 8), depending on the extent to which the classifying flow has to be deflected or the number of fractions into which the fine material has to be divided when withdrawn from the classifying region 7 into the outflow channel or channels. In the region where the flow channel curves, the inflow channel is connected to the radially inward outflow channel 3 by an inwardly curved deflection wall 1, which can extend over an angle of 45° or more. The angle around which the inner deflection wall 1 extends is the inner deflection angle $\alpha_i$, which is about 130° in the embodiment in FIG. 1. It extends from the beginning of the curvature of the inner deflection wall 1 to the front edge of the outer boundary wall of the inner outflow channel 3 (see FIG. 1). The inner deflection wall 1 is continuously curved around the inner deflection angle $\alpha_i$. On the side of the inner deflection wall or the inner side of the flow channel, a material supply device terminates in the neighborhood of the beginning of the inner channel curvature, near the inner deflection wall 1. The supply device is used for supplying a stream of material in a thin layer and in a direction deviating by less than 45° from the classifying flow inside the flow channel. In the embodiments shown in FIGS. 1–8 and 10–12, the material supply device comprises a channel 10 for supplying a flow of carrier substance, e.g., air or water, charged with a flow of material, the channel terminating at the flow channel wall (see FIGS. 1–5, 7, 8, 10, 12) or at a slight distance therefrom inside the flow channel (see FIGS. 6, 11). The height of the opening radially and transverse to the classifying flow direction is small compared with the radial dimension of the flow channel.

On the side opposite the point at which material is introduced into the flow channel, the channel wall is formed with a coarse material outlet aperture 8 from which coarse material escapes from the classifying flow. Its end forms an edge 21 oblique to the trajectories of the material, the edge being on the outer boundary wall of the outer outflow channel 3 (see FIG. 12) or of the outer outflow channel 4 (see FIGS. 1, 2, 4, 6, 7, 9–11) or of the outer outflow channel 5 (see FIG. 5) or of the outer outflow channel 6 (see FIGS. 3, 8). The edge 21 forming the end of the coarse material outlet aperture 8 is disposed in line with the outer channel wall ending at an edge 25 at the beginning of the coarse material outlet aperture, or is somewhat radially offset therefrom (outwardly offset in FIG. 3). The outer classifying flow boundary or the jet boundary of the classifying flow, which has the form of a wall jet in the neighborhood of classifying region 7, is between the outer edge 25 of the inflow channel 2 forming the beginning of the coarse material outlet aperture and the edge 21 forming the end of the coarse material outlet aperture. The angular extension of the coarse material outlet aperture corresponds to the outer deflection angle $\alpha_a$ of the classifying flow deflected at the inner deflection wall 1. The outer deflection angle should be less than the inner deflection angle $\alpha_i$. In the embodiments shown, the ratio between the radii of the outer and the inner curvature of the flow channel is approximately 3:1 to 2:1. The classifying flow in the flow channel is adjacent an outer flow 9 for withdrawing the fraction of coarse material, at the outside along the coarse material outlet aperture 8, along which the classifying flow is not guided by a wall. For this reason, a supply channel 12 for fluid largely free from material is provided on the side of the coarse material outlet aperture 8 near the flow channel and opens into a coarse material discharge device at the beginning of the coarse material outlet aperture 8. The material free fluid flows out of channel 12 substantially parallel to the classifying flow. The material discharge device, which is adjacent the coarse material outlet aperture outside the flow channel, can be constructed as a coarse material collecting vessel 13*a* having a funnel-shaped lower part, from which accumulated coarse material can be removed by means of a bucket wheel lock 17 (see FIGS. 2, 3, 8).

The fluid supplied through the channel 12 for the external flow 9 has to be discharged from the coarse material collecting vessel. After the flow has been reflected upwards in the bottom part of the vessel along the semicircular line 15 shown in FIG. 2, it reaches the outer wall together with that part of the coarse material which has not been ejected by gravity through the deflection, and is discharged through an upwardly extending outlet channel 16. The fluid, which forms an inner vortex core 18, is further deflected by the upper, substantially semicircular curved wall 19 of the collecting vessel 13*a* nearly as far as the flow channel and in the direction of the classifying flow substantially parallel to the coarse material outlet aperture 8.

Figure 10:
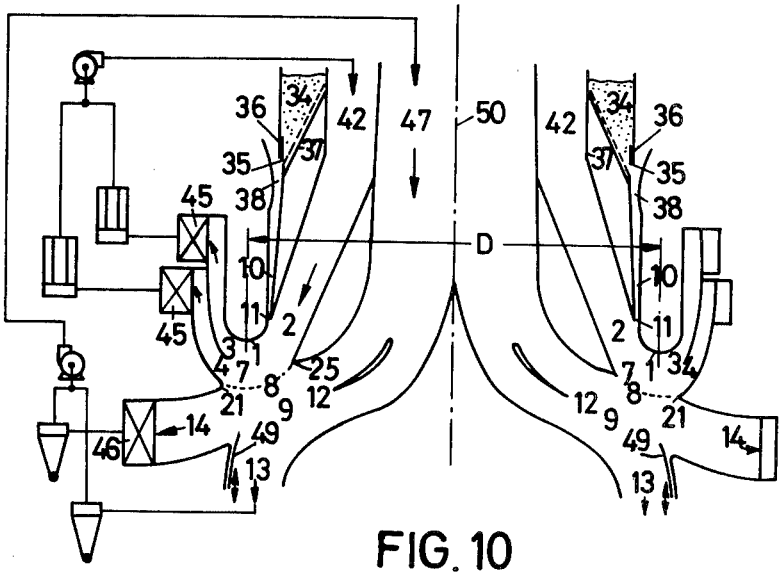
FIG. 10 is a diagrammatic vertical section through an axially symmetrical classifying device in which material is pneumatically supplied to the classifying region from above and below.
Figure 11:
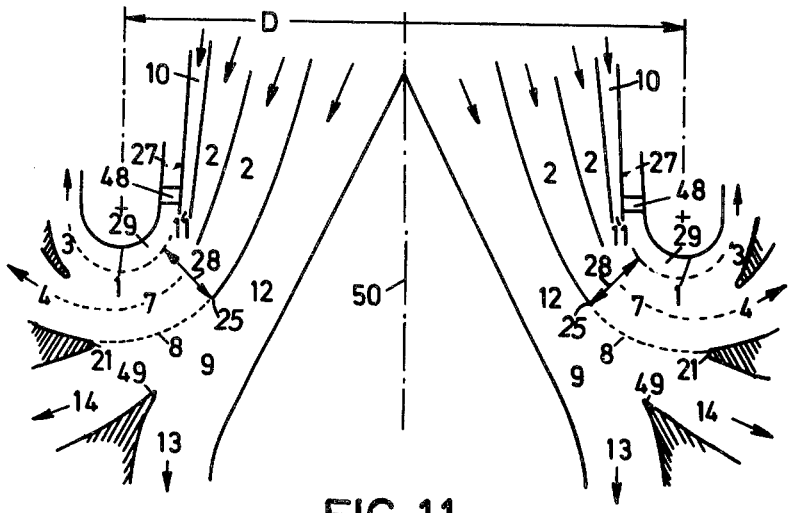
FIG. 11 is a diagrammatic vertical section through an axially symmetrical classifying device in which material is pneumatically supplied to the classifying region at a distance from the inner boundary wall of the inflow channel.

In the flat classifying device shown in FIG. 1 and the axially symmetrical device shown in FIGS. 10 and 11, the coarse material discharge device has two outflow channels 13 and 14, one beside the other adjacent aperture 8 for partial flows of the outer flow laden with a fraction of coarse material. The outflow channel 14 is used for removing the finer fraction of coarse material, whereas the coarser fraction is removed through channel 13, which extends outwards substantially in the average direction of travel of the coarse material. Separators for collecting the two fractions can be connected to channels 13, 14. Alternatively, all the coarse material can be removed, substantially in the central direction of travel, through a single channel 13 (see FIGS. 7, 12).

In the axially symmetrical embodiment, as shown in FIG. 10, the outflow channel 14 ends in a spiral channel 46 in which the fluid is collected and from which the fluid is withdrawn. In the same embodiment, the outflow channels 3, 4 for the classifying flow each end in a volute channel 45.

In all the embodiments, the material to be classified is introduced through a narrow aperture 11 of a supply channel 10 into a deflected classifying flow flowing from channel 2 into region 7 in which the material is fanned out and therefrom into the outflow channels 3, 4 etc. In the embodiments in FIGS. 1–8 and 10–12, the material is suspended in a carrier flow and accelerated to the speed at which it is introduced at the material introduction point. Advantageously, this speed is equal to the speed of the classifying flow. In the axially symmetrical embodiment in FIG. 9, the material is accelerated by a coaxially rotating centrifugal plate 31 on which the material is supplied downwards via a central shaft. Advantageously, the centrifugal plate 31, which is driven by a motor 33, is concave and conical in known manner. A material supply channel 10 covered by a wall 32 rotating therewith or a centrifugal plate cover is disposed above plate 31. A flow of gas can also be introduced through channel 10, so that the material, particularly the fine particles, is additionally accelerated by pneumatic means. In view of the explanations in the previously mentioned patent specifications the disclosure of which is hereby incorporated by reference, additional information about the construction of an axially symmetrical classifier comprising a rotating centrifugal plate, about the supply of material thereto, its function, the construction of the flow channels, etc. will not be given herein.

Figure 9:
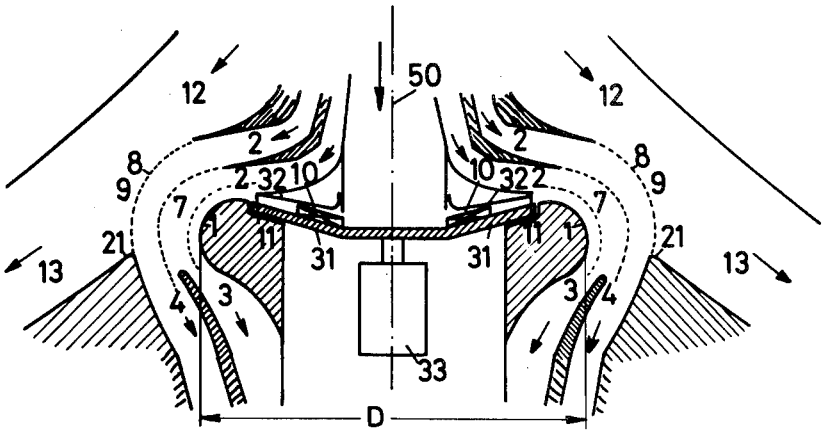
FIG. 9 is a cross-section through an axially symmetrical classifying device, diagrammatically indicated in the neighborhood of the classifying region, supplied with material by a centrifugal plate.

When a centrifugal plate is used for supplying material, the inner deflection wall 1 can be stationary (see FIG. 9). Alternatively, it can be connected to the centrifugal plate 31 and rotate therewith. When the deflection wall is stationary, the particles of material and the flow introduced therewith more round the central axis 50, and this motion is superposed on the motion in the radial plane. When the wall rotates as well, a rotating component of the classifying flow boundary layer and, if required, of the classifying flow is additionally superposed.

Figure 12:
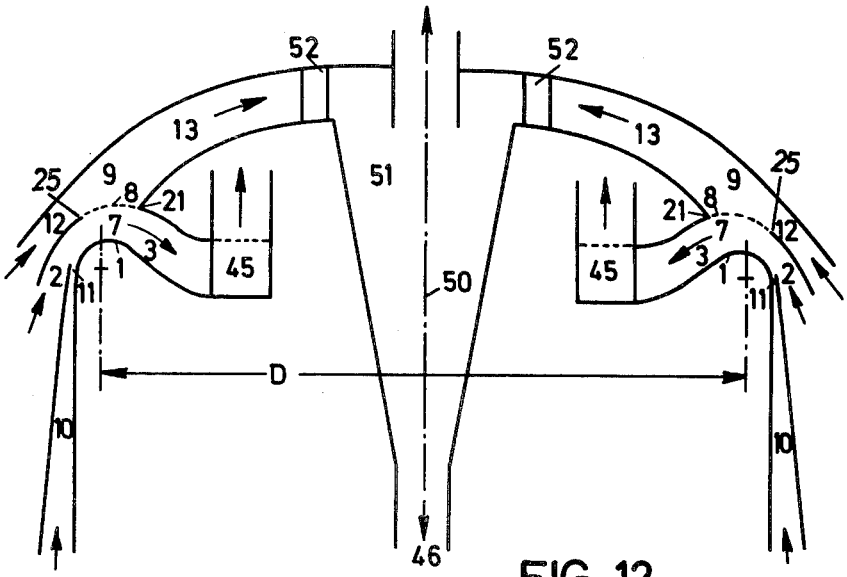
FIG. 12 is a diagrammatic vertical section through an axially symmetrical classifying device in which material is pneumatically or hydraulically supplied to the classifying region vertically upwards.

For high throughputs, it is advantageous to use the axially symmetrical device, the material being introduced by pneumatic or hydraulic means (FIGS. 10–12).

Figure 6:
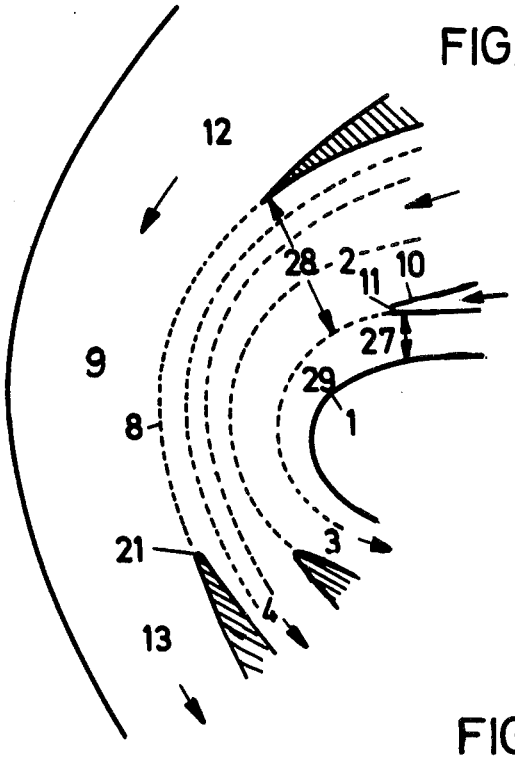
FIG. 6 is a similar view of the classifying region of a flat classifying device with the mouth of a feed device displaced into the inflow.

In the classifying devices in FIGS. 6 and 11, the stream of material is introduced at point 11 at a radial distance 27 from the inner deflection wall 1. Distance 27 should be less than the radial distance 28 from the outer boundary wall of the classifying flow. In that case a classifying flow 29 directly adjacent the inner deflection wall 1 remains substantially free of material.

Figure 7:
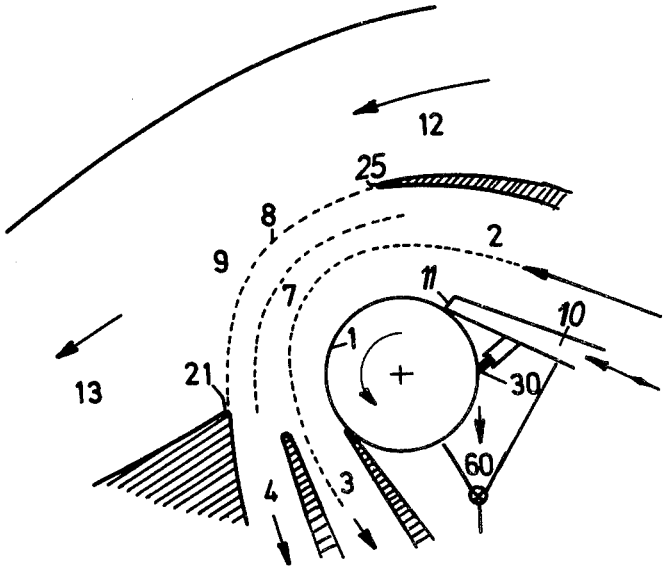
FIG. 7 is a similar view of a flat classifying device having an inner deflection wall constructed as a rotating cylinder.
Figure 8:
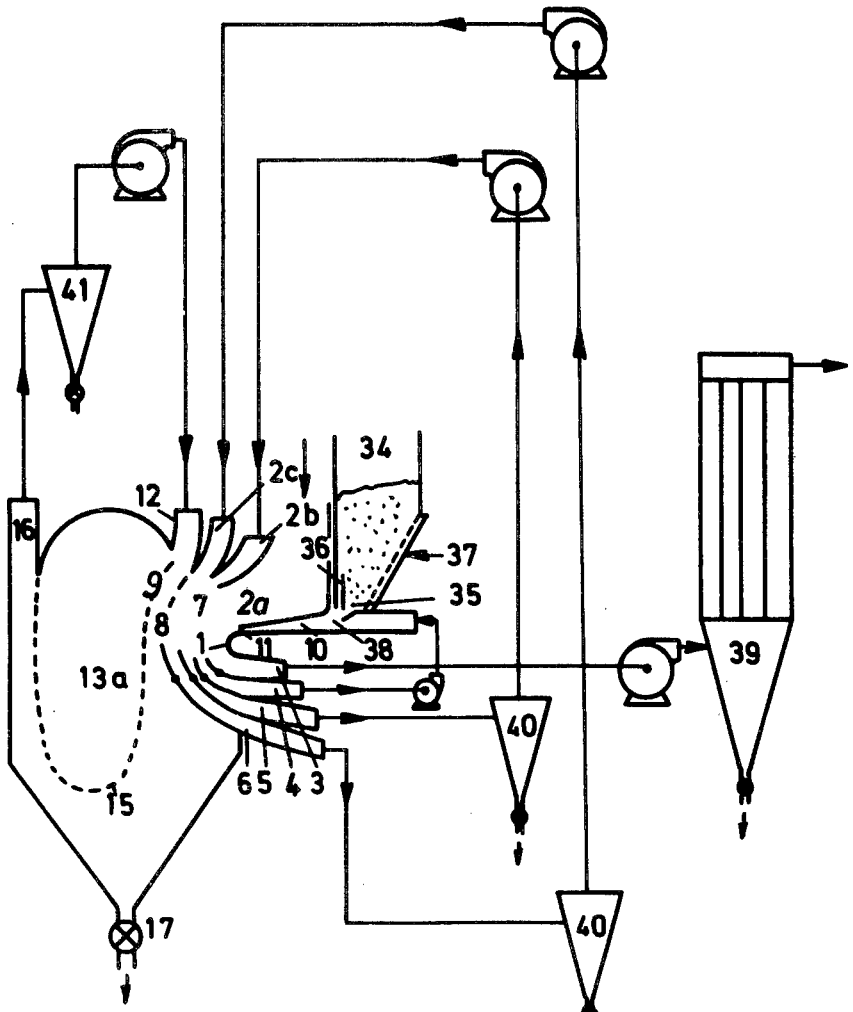
FIG. 8 is a block diagram of a complete air classifying device comprising a flat classifier according to the invention.

FIG. 7 shows a device for preventing material from sticking to the inner curved deflection wall. The inner wall 1 is a slowly rotating circular cylinder driven by a motor (not shown). The classifying flow is adjacent the front side facing the classifying region 7. Any adhering fine material is removed from the rear side by scrapers 30 or brushes or similar devices and collected in a vessel 60 underneath.

When material enters region 7 through channel 10, the fine material is strongly deflected by the flow and entrained thereby through the discharge channels for the classifying flow. The coarse material, on the other hand, moves along flatter trajectories via edge 21 of the outer boundary wall of the outflow channel or of the outermost outflow channels through the coarse material outlet aperture into the coarse material discharge device. In the classifier in FIGS. 1, 10, 11 the coarse material flowing through the outer classifying flow boundary flows into a coarse material channel 13 disposed substantially in the average direction of flow of the coarse material. The outer flow, which is supplied largely free of material through the inflow channel 12, travels out through channel 13 and entrains the coarse material. However, part of the outer flow is discharged through the outflow channel 14 in the embodiments in FIGS. 1, 2, 10 and 11. In this case, the coarse material is further classified through the outer flow 9 into a finer fraction ejected through channel 14 and a coarser fraction ejected through channel 13. The subsequent classification of the coarse material outside region 7, produced by the outer flow 9 as shown in FIG. 1, is a combined process of deflection and cross-flow classification, as in the device in FIG. 10.

Advantageously, in order to adjust the cut-off sizes, the boundary walls of the outflow channels are made adjustable so that the position of their front edges can be changed in the deflection and radial direction. The position in the radial direction can be adjusted in combined manner with valves, as is known. Displacement means can also be provided for adjustment in the deflection direction. It is important for the outflow channels to be completely sealed from one another. Often, therefore, it is advantageous to use different exchangeable boundary walls.

FIG. 8 shows an advantageous air classifying device. Material is supplied pneumatically into the classifying region. In order to carry out the method according to the invention, it is very important for the material supplied at point 11 to be introduced at a constant speed into the classifying region. According to the invention, in the case of pneumatic supply, this can be achieved in a particularly advantageous manner if a pressure measuring section is provided in a pneumatic conveying section of channel 10 in front of point 11 in region 7, the resulting pressure drop in the pressure measuring section being used to adjust the flow of material. Advantageously, the outflow from an outlet aperture 35 of a collecting vessel 34 constructed as a mass flow bunker is adjusted by moving a slide valve 36 or similar valve device. All oblique walls 37 of bunker 34 are aerated to ensure a uniform stream of material. Slide valve 36 is provided in front of the outlet aperture 35. The material flowing out of aperture 35 is introduced by an injector 38 into the material supply channel 10, and from its mouth at point 11 into the classifying region 7. Here it is separated into four fractions of fine material, which are discharged through channels 3, 4, 5, 6. The boundary walls of these channels are adjustable. The discharged fractions are separated either in filters 39 or cyclones 40. Separation should be substantially complete. It is therefore advantageous to use filters if the fractions contain relatively high proportions having a particle size below 5–10 $\mu$m. In the classifier in FIG. 8, a filter is provided for the very fine fraction discharged through channel 3, whereas the coarser fractions of fine material discharged through channels 5, 6 are separated in cyclones 40. In order to ensure specially sharp separation between the fractions discharged in channels 3 and 5, the fraction of fine material discharged in channel 4 is conveyed in a closed cycle. The air carrying it is advantageously used for accelerating the material in channel 10. The air, after being freed from fine material in cyclones 40, flows back to region 7 through channels 2*b* and 2*c*. The air discharged through channel 3 flows to the atmosphere through filter 39 after the finest fraction has been separated. A corresponding amount of air is sucked in through channel 2*a*. The coarse material travels through aperture 8 from region 7 into the outer flow 9 supplied through channel 12. The outer flow travels in a semicircle in the bottom part of vessel 13*a* and comes out at the top through an outlet channel 16. Some of the coarse material is ejected through the bucket wheel lock 17. The rest is separated by a cyclone 41 from the outer flow, which is largely free of material when it is again supplied through channel 12.

FIG. 10 shows an axially symmetrical classifier for high throughputs, in which the material flows from an annular feed vessel 34 (constructed as before as a mass flow bunker) through an adjustable outlet aperture 35 into an annular vertical supply channel 10. Vessel 34 has a vertical wall and an oblique aerated bottom wall 37. The amount flowing out can be adjusted to a constant value by means of a pressure drop, which can be measured by devices (not shown) in a pressure measuring section in the acceleration part of channel 10, the slide valve 36 being correspondingly adjusted by a regulator. A downward flow occurs in channel 10 and accelerates the material to the material introduction speed at which it leaves aperture 11 and enters the classifying flow at the beginning of the curved inner deflection wall 1 and in the same direction. Acceleration is produced by mainly pneumatic means. It is not appreciably increased by gravity, except for large prticles above 1 mm and when the material is supplied at a slow rate. All other features for working the classifying method according to the invention can be directly seen from FIG. 10, with reference to the notation which has already been explained. The outer flow 9 supplied through channel 12 results in cross or transverse flow classifying of the coarse material into a coarser fraction discharged through channel 13 and a finer fraction discharged through channel 14. In order to vary the cut size between the two fractions of coarse material, a knife edge 49 can be vertically moved along the inner edge between channels 13 and 14. The channels for supplying and subsequently discharging the fluid for the classifying flow and the external flow can be constructed in various ways. In FIG. 10, for example, material is supplied through central channels 42, 47 and discharged through a volute casing 45, 46. It can be seen that, if material is supplied vertically downwards by pneumatic means, the classifying device can have a compact, very advantageous construction, since the volute casings 45, 46 are, e.g., relatively near the central axis 50 and the supply channel 2 for the classifying flow and the channel 12 for the outer flow are likewise at or near axis 50, at a slight inclination thereto, the main reason for space savings being that the coarsest fraction is discharged through channel 13 vertically downwards and not outwards, resulting in larger diameters.

FIG. 11 shows an axially symmetrical deflection classifier according to the invention which is somewhat different from FIG. 10 but basically has the same structure. Material is introduced at point 11, at a small radial distance 27 from the inner deflection wall 1, the distance being less than the radial distance 28 from the outer aperture 8. Consequently, there is a material free flow layer 29 between 11 and wall 1. Vanes paddles or the like 48 between channel 10 and the flow channel wall adjacent the deflection wall 1 at the front impart a rotating flow component around axis 50 to the flow layer 29. This facilitates deflection through a large angle of the classifying flow adjacent the inner wall 1. A similar rotating flow component can also be imparted to the classifying flow entering through channel 2 and/or to the flow of material supplied through channel 10. In principle, a classifying device according to the invention constructed as in FIGS. 10 and 11 can also be applied to liquid fluids.

FIG. 12 shoes an axially symmetrical embodiment in which the flow of material is supplied upwards to region 7 through a channel 10 extending upwards to its inflow aperture. This construction is particularly suitable for combination with mills, e.g., bowl mills, disposed immediately under a classifying device. Thus the material is conveyed by an air stream immediately out of the mill through channel 10 into the classifying region. As before, the fanning out of the material in region 7 can be used for withdrawing a number of fractions of fine material from region 7 through a number of outflow channels 3, 4 etc. If only one fraction of fine material is required, a single outflow channel 3 is sufficient, as shown in the classifier in FIG. 12. The coarse material flowing through aperature 8 enters the outer flow 9, supplied through channel 12, and is discharged through channel 13. The flows charged with fine material and coarse material can be further guided in various ways. In FIG. 12, the outer flow, charged with coarse material, is supplied via tangential guide vanes 52 to a central cyclone 51. If required, coarse material separated at the center is returned to the mill through a line 46 in a stream of air. Advantageously, a number of channels are used for discharging the classifying flow charged with fine material, which emerges through channel 3 in annular manner out of the classifying region. Cyclones can be directly connected downstream, or alternatively the flow can be divided into channels and discharged upwards through the bend 45 shown in FIG. 12. As before, the construction is particularly simple and compact in the case of the last-mentioned embodiment of a classifying device according to the invention, which is particularly suitable for material already suspended in a carrier flow and in which material is vertically supplied upwards into the classifying region.

However, axially symmetrical embodiments in which material is supplied by pneumatic or hydraulic means from above (FIG. 10) or from below (FIG. 12) have a common feature in that the classifying flow can be deflected either outwards or inwards. FIGS. 10 and 12 each show only one possibility. In the embodiment in FIG. 11, outward deflection occurs only. In the case of both outward and inward deflection, the deflected classifying flow does not have exact parallelism if the annular inflow and outflow channels of the classifying flow have equal cross-sections. The streamlines converge somewhat in the case of outward deflection, whereas they diverge slightly in the case of inward deflection. The latter condition is more favorable for classifying. When the diameter D (see FIGS. 9, 10, 12) is large in comparison with the radial dimension of the classifying flow, the deviation from parallelism is unimportant.

We claim:

1. A method of continuous centrifugal classifying of a continuous stream of particulate material into at least one fraction of coarse material and at least one fraction of fine material in a deflected flow, the material to be classified being classified in a gaseous fluid at cut-off sizes between approximately 1 μm and 100 μm and a mass flow ratio up to 10, between the supplied stream of material and a classifying gas flow, and being classified in a liquid fluid at cut-off sizes between approximately 10 μm and 1 μm, comprising:

(a) providing a curved inner deflection wall curved from a beginning over an inner deflection angle greater than 45°;

(b) establishing a classifying fluid flow which is deflected in a classifying region by said curved inner deflection wall and has, as an inner boundary, said curved inner deflection wall and has a curved outer boundary which is not covered by a wall over an outer angle smaller than said inner deflection angle, the classifying flow being substantially parallel to said inner deflection wall and abutting said inner deflection wall at least over said inner deflection angle;

(c) establishing an outer flow for carrying away the fraction of coarse material, the outer flow establishing the outer boundary of said classifying flow over said outer angle the ratio of radii between said outer boundary and inner deflection wall of said classifying flow being less than approximately 5:1;

(d) introducing a stream of material to be separated into the classifying flow in a thin layer in the vicinity of the beginning of curvature of the inner deflection wall in a direction such that the vector component of its velocity in the direction of the classifying flow is at least half the value of the velocity of the classifying flow and in a direction which does not deviate more than 45° from the direction of the classifying flow, whereby fine material, after being fanned out by centrifugal force is discharged primarily with the out-flowing classifying flow, and the coarse material passes through said outer boundary of the classifying flow which is not covered and is discharged primarily with the outer flow.

2. The method according to claim 1 for moderately fine cut-off sizes wherein said inner deflection angle is at least 60° and said flow of material to be classified is introduced into the classifying flow adjacent the curved inner deflection wall.

3. The method according to claim 1 for very fine cutoff sizes wherein said inner deflection angle is at least 90° and said material to be classified is introduced into the classifying flow adjacent said curved inner deflection wall.

4. The method according to claim 1 wherein said classifying flow is established so as to be a substantially homogeneous classifying flow having a ratio between its radii of external and internal curvature which is between 3:1 to 2:1.

5. The method according to claim 1 wherein the stream of material to be classified is introduced with a speed whose component in the direction of the classifying flow is substantially equal to the speed of the classifying flow at the point of introduction.

6. The method according to claim 1 wherein the flow of material to be classified is introduced into the classifying flow in the direction of said classifying flow.

7. The method according to claim 1 wherein the stream of material to be classified is introduced into the classifying flow at an angle to the direction thereof at the place of introduction, and having an outwardly directed speed component which is smaller than the speed component of said flow in the direction of the classifying flow.

8. The method according to claim 1 for classifying a flow of material in a gaseous fluid wherein said classifying flow is established to have a speed within the classifying region which is kept at a substantially constant value between 10 m/sec and 300 m/sec.

9. The method according to claim 1 wherein said outer flow for removing coarse material is supplied in a substantially material free manner substantially parallel to said classifying flow and is discharged in an outward direction substantially in the travel direction of the coarse material.

10. The method according to claim 1 wherein said external flow for discharging the coarse material is directed to a wide coarse material chamber, and wherein said external flow is initially guided substantially parallel to the boundary of the classifying flow and guided behind said boundary substantially in a semicircle and discharged at the outer wall of the coarse material chamber along with the coarse material or the portion thereof not deposited by gravity, said coarse material chamber being arranged so that an inner eddy current is produced therein by said outer flow in said chamber, said inner eddy current so aligned that, as a result of the supply and discharge of the outer flow and the intermediate deflection at an outer wall, the particles of coarse material therein are driven only in a direction toward the outer wall.

11. The method according to claim 1 and further including the step of classifying the coarse material in the outer flow into at least two fractions, the outflow side of said outer flow being divided into two or more partial flows, the outer most one of which is used for removing the coarsest fraction.

12. The method according to claim 1 and further including the step of dividing the classifying flow coming from the classifying region after deflection into an inner and at least one outer flow layer and separately discharging said flow layers with the fractions of fine material contained therein.

13. The method according to claim 1 wherein said flow of material to be classified is introduced into the classifying flow at a radial distance from the inner deflection wall which is less than the radial distance from the outer classifying flow boundary.

14. The method according to claim 1 for classifying a stream of material in a gaseous fluid and further including the step of suspending said stream of material in a carrier when conveyed into the classifying flow and maintaining a pressure drop along at least a portion of the conveying section constant by adjusting said stream of material.

15. Apparatus for continuous centrifugal classification of a continuous stream of particulate material into at least one fraction of coarse material and at least one fraction of fine material in a deflected flow, the material to be separated being in a gaseous fluid for cut-off sizes between approximately 1 μm and 100 μm and a mass flow ratio of the supplied material to a classifying gas flow of up to approximately 10 and in a liquid fluid for cut-off sizes between approximately 10 μm and 1 mm comprising:

(a) a flow channel for conveying a classifying flow which is continuously curved inwardly with a deflection angle of greater than 45° to form a classifying region, the flow channel defined on its inside by a curved inner deflection wall having a curvature which begins near the entry point of the classifying flow into the classifying region and on its outside by a curved outer wall;

(b) a material supply device opening into one side of said channel at a material introduction point in the region of the beginning of the curvature of the inner deflection wall said supply device arranged to supply a stream of material to be classified in a thin layer in a direction deviating by not more than 45° from the classifying flow at that point;

(c) a coarse material discharge aperture in said outer wall for discharging coarse material from the classifying region opposite the material introduction point, said coarse material discharge aperture having an upstream and a downstream edge defined by said outer channel wall of said flow channel, the discharge aperture being an opening in said outer channel wall and forming a continuation thereof and the discharge aperture extending over an outer deflection angle, the ratio between the radii of the outer and inner walls of the flow channel being less than 5:1, (d) a coarse material discharge device adjacent said coarse material outlet aperture outside the flow channel; and, (e) a supply channel for a material free fluid opening opposite the material introduction point at the beginning of the coarse material discharge aperture such that the fluid emerges from said supply channel substantially parallel to the classifying flow, said material free fluid being used to discharge the fraction of coarse material.

16. Apparatus according to claim 15 wherein said curved inner wall is curved over an inner deflection angle of at least 60°.

17. Apparatus according to claim 15 wherein said curved inner wall is curved over an inner deflection angle of at least 90°.

18. Apparatus according to claim 15 wherein the ratio between the radii of outer and inner curvature of said flow channel is between 3:1 and 2:1.

19. Apparatus according to claim 15 wherein the radius of curvature of the inner deflection wall of the flow channel is at least 1 cm.

20. Apparatus according to claim 15 wherein the curvature of the inner deflection wall of the flow channel increases in the flow direction.

21. Apparatus according to claim 15 wherein the downstream edge of said outer wall of the flow channel ends near and in front of the trajectory of the coarsest particles.

22. Apparatus according to claim 15 wherein the flow channel in the flow direction behind the downstream edge of the coarse material discharge aperture is divided into at least two outflow channels for the classifying flow, the outflow channels having streamlined smooth boundary walls and the front edges of the boundary walls, which determine the cut-off sizes of the fractions of fine material being disposed outwardly at progressively smaller deflection angles.

23. Apparatus according to claim 22 wherein the distances between the front edges of the outflow channels for the classifying flow are so adjusted in the radial direction and the deflection direction to the particle size of the fractions of fine material and the loading that the disturbances to parallel flow, which originate at the inner surfaces of those parts of the boundary walls projecting into the deflected classifying flow and are amplified by friction, do not spread along the internally adjacent boundary wall into the next internal outflow channel.

24. Apparatus according to claim 15 wherein said material supply device has a supply channel for a carrier flow charged with a flow of material, the supply channel terminating at least near the curved inner deflection wall inside the flow channel with the height of the supply channel aperture radially transverse to to the classifying flow direction being small compared with the radial width of the flow channel.

25. Apparatus according to claim 24 and further including a mass flow bunker with walls containing aeration openings and an outlet aperture and means for automatically adjusting the effective size of said outlet aperture in dependence on the pressure drop along at least a part of the material supply channel to ensure uniform delivery of material into the material supply channel.

26. Apparatus according to claim 24 wherein said flow channel has a annular cross section with said material supply device opening in axially symmetrical manner coaxially on its inner side, and the coarse material outlet aperture and an axially symmetrical coarse material discharge device are disposed coaxially on its outer side.

27. Apparatus according to claim 26 wherein the central axis of the flow channel is substantially vertically aligned and the channel for supplying the carrier flow charged with the flow of material extends downwards to the mouth of said flow channel.

28. Apparatus according to claim 26 for classifying a stream of material suspended in a carrier stream wherein said central axis of the flow channel is substantially vertically aligned and the material supply channel inside the flow channel extends upwards to its mouth and the stream of carrier and material is directly introduced into the material supply channel.

29. Apparatus according to claim 15 wherein said coarse material discharge device has a coarse material channel for removing fluid charged with coarse material, said channel extending outwardly substantially in the direction of travel of the coarse material.

30. Apparatus according to claim 15 wherein said coarse material discharge device has a coarse material collecting vessel which is adjacent the coarse material outlet aperture outside the flow channel, said collecting vessel formed such that the fluid charged with coarse material is deflected substantially in a semicircle after passing the coarse material outlet aperture and having an outlet in the outer wall through which said fluid together with that portion of the coarse material which has not been discharged as a result to the deflection and gravity is discharged, said collecting vessel further formed such that the fluid forming an inner eddy core is deflected substantially parallel to the coarse material outlet aperture near to the flow channel and in the direction of the classifying flow.

31. Apparatus according to claim 15 wherein said coarse material discharge device has a number of outflow channels spaced close together adjacent the coarse material discharge device at the coarse material outlet aperture, for partial flows charged with fractions of coarse material.

32. Apparatus according to claim 15 wherein said flow channel has a substantially rectangular cross-section, said material supply device opening into one side of said channel and said coarse material outlet aperture and the coarse material discharge device being disposed on the opposite side of the flow channel.

33. Apparatus according to claim 32 wherein said inner deflecting wall is a circular cylinder disposed for rotation around its longitudinal axis, the front side of said inner deflecting wall being adjacent the deflected classifying flow and further including means at rear side, opposite said classifying flow, for removing any fine material adhering to said rear side.

34. Apparatus according to claim 15 wherein said flow channel has a annular cross section with said material supply device opening in a axially symmetrical manner coaxially on its inner side, and the coarse material outlet aperture and an axially symmetrical coarse material discharge device are disposed coaxially on its outer side.

35. Apparatus according to claim 34 wherein said material supply device comprises a coaxial centrifugal plate formed with a central material supply shaft.

36. Apparatus according to claim 34 wherein said inner deflecting wall curves outwardly away from the central axis and further including means for guiding the flow, so that the classifying flow supplied free of material between the inner wall and the material introduction point has a flow component rotating around the central axis.

37. Apparatus according to claim 36 wherein said means for guiding the flow are further arranged to guide the carrier flow for introducing material so that the carrier flow for introducing material also has a flow component rotating around the central axis.

* * * * *

UNITED STATES PATENT AND TRADEMARK OFFICE

CERTIFICATE OF CORRECTION

PATENT NO. : 4 153 541

DATED : May 8, 1979

INVENTOR(S) : Hans Rumpf et al

It is certified that error appears in the above-identified patent and that said Letters Patent are hereby corrected as shown below:

In the Abstract, line 9, after "45°" delete --and--

In Column 3, line 21, change "material" to --particles--

Column 3, line 30, change "$D_{75}/d_{50}$" to --$d_{75}/d_{50}$--

Column 3, line 36, change =$D_{99.99}$" to --$d_{99.99}$--

Column 3, line 54, after 45°" delete first --and--

Column 4, line 60, after "deflecting wall." insert --In the flow direction in front of and behind --

Column 4, line 63, change "or" to --of--

Column 13, line 42, after "sectional" insert --schematic--

Column 15, line 48-49, change "reflected" to --deflected--

UNITED STATES PATENT AND TRADEMARK OFFICE

CERTIFICATE OF CORRECTION

PATENT NO. : 4 153 541

DATED : May 8, 1979

INVENTOR(S) : HANS RUMPF ET AL

It is certified that error appears in the above-identified patent and that said Letters Patent are hereby corrected as shown below:

Column 24, line 5, change "to" to --of--

Column 24, line 27, after "at" insert --its--

Signed and Sealed this

*Twentieth* Day of *May 1980*

[SEAL]

*Attest:*

SIDNEY A. DIAMOND

*Attesting Officer*

*Commissioner of Patents and Trademarks*